United States Patent [19]

Bejean et al.

[11] Patent Number: 5,029,889

[45] Date of Patent: Jul. 9, 1991

[54] CROSS-COUNTRY SKI APPARATUS

[75] Inventors: Alain Bejean, Alby sur Cheran; Benoit Saillet, Albens, both of France

[73] Assignee: Salomon S.A., Annecy Cedex, France

[21] Appl. No.: 386,711

[22] Filed: Jul. 31, 1989

[30] Foreign Application Priority Data

Aug. 3, 1988 [FR] France ..... 88 10493

[51] Int. Cl.[5] ..... A63C 5/04

[52] U.S. Cl. ..... 280/607; 280/615; 280/636

[58] Field of Search ..... 280/615, 614, 607, 636, 280/610, 635

[56] References Cited

U.S. PATENT DOCUMENTS

| | | | |
|---|---|---|---|
| 4,353,576 | 10/1982 | Salomon | 280/615 |
| 4,789,177 | 12/1988 | Graillat | 280/607 |
| 4,850,609 | 7/1989 | Hue | 280/615 |

FOREIGN PATENT DOCUMENTS

| | | | |
|---|---|---|---|
| 3518457 | 12/1985 | Fed. Rep. of Germany | 280/615 |
| 2568479 | 7/1985 | France | 280/610 |
| 2590131 | 11/1985 | France | 280/615 |
| 2595578 | 3/1986 | France | 280/615 |
| 54336 | 9/1934 | Norway | 280/636 |
| 84811 | 11/1954 | Norway | 280/607 |

*Primary Examiner*—David M. Mitchell

*Attorney, Agent, or Firm*—Sandler, Greenblum, & Bernstein

[57] ABSTRACT

A cross-country ski and an apparatus for supporting a shoe or boot on a cross-country ski which has an upwardly projecting longitudinally extending rib. The apparatus includes a front support element positioned on either side of the longitudinally extending rib proximate an area of the ski at which a front binding is to be located, and a rear support element longitudinally spaced from the front support element and located on either side of the longitudinally extending rib proximate an area of the ski at which the heel of a shoe or boot is to be located during the course of skiing. The materials from which the front and rear support elements are made and their respective mechanical response characteristics are selected with respect to the ability level of the skier and with respect to the type of skiing that is to be performed.

34 Claims, 1 Drawing Sheet

CROSS-COUNTRY SKI APPARATUS

BACKGROUND OF THE INVENTION

1. Field of the Invention

The present invention relates to a cross-country ski includes a longitudinal rib projecting from its upper surface and a shoe or boot support apparatus.

2. Discussion of Background and Relevant Information

Cross-country skis are known to include a generally trapezoidal transverse cross-section. In other words, the rib is defined by an upper horizontal surface and two inclined lateral surfaces. The trapezoidal cross-section rib connects with the lower part of the ski, which typically has a rectangular cross-section, including sides having a relatively low height. Because of the reduced height of the sides, the cross-country ski glides more easily on snow.

Furthermore, the upper longitudinal rib contributes to the lateral guidance of the shoe or boot which is held in front, on the cross-country ski, by means of a binding. The shoe or boot is guided by virtue of the provision, in its sole, of a groove having in cross-section a shape complementary to that of the ski rib.

SUMMARY OF THE INVENTION

It is an object of the present invention to provide an improvement in cross-country skis which permits the adaptation of the rigidity or flexibility of the ski to the level of ability of the skier and the improvement of its technical characteristic without appreciably increasing the weight of the ski.

To this end, the present invention includes a cross-country ski and a support apparatus for a cross-country ski having a longitudinally extending rib in which the support apparatus includes:

(a) means for supporting a front portion of a shoe or boot on either side of the longitudinally extending rib during cross-country skiing; and (b) means for supporting a rear portion of the shoe or boot on either side of the longitudinally extending rib during cross-country skiing, which is to be distinct from and longitudinally spaced rearwardly from the means for supporting a front portion of the shoe or boot.

It is another object of the present invention to provide a support apparatus in which the means for supporting a front portion of the shoe or boot and the means for supporting a rear portion of the shoe or boot are made of materials having identical, or substantially identical, mechanical response characteristics.

Alternatively, it is also an object of the present invention to provide a support apparatus in which the means for supporting a front portion of the shoe or boot and the means for supporting a rear portion of the shoe or boot are made of materials having different mechanical response characteristics.

For example, means for supporting a front portion of the shoe or boot can be support elements made, selectively, from elastic or soft material or from rigid material.

Further, the means for supporting a front portion of the shoe or boot can be comprised of a relatively rigid material and the means for supporting a rear portion of the shoe or boot can be comprised of a relatively soft, shock-absorbing material.

In one aspect of the invention, the means for supporting a front portion of the shoe or boot and the means for supporting a rear portion of the shoe or boot are attached to the ski with glue.

In another aspect of the invention, the longitudinally extending rib has side surfaces and the ski has further side surfaces spaced from the side surfaces of the rib, wherein the means for supporting a front portion of the shoe or boot and the means for supporting a rear portion of the shoe or boot are each constituted by material layers which are affixed directly to the side surfaces of the rib and to the ski between the side surfaces of the rib and the further side surfaces of the ski.

In a further aspect of the invention, the support apparatus includes longitudinally spaced front and rear intermediate elements, wherein the means for supporting a front portion of the shoe or boot and the means for supporting a rear portion of the shoe or boot each comprise a material layer which is affixed onto respective surfaces of the front and rear intermediate elements.

In a still further aspect of the invention, the ski includes inclined edge surfaces and the means for supporting a front portion of the shoe or boot and the means for supporting a rear portion of the shoe or boot are affixed to an inclined edge surface, each of the means for supporting a front portion of the shoe or boot and the means for supporting a rear portion of the shoe or boot have relatively horizontal support surfaces for supporting respective portions of the shoe or boot.

BRIEF DESCRIPTION OF THE DRAWINGS

An embodiment of the present invention will be described below, by way of non-limiting example, with reference to the annexed drawing in which.

DETAILED DESCRIPTION OF THE PREFERRED EMBODIMENTS

As discussed above, the present invention relates to improvements in a cross-country ski, an object of which is to easily adapt the rigidity or flexibility of the ski to the level of ability of the skier and to improve the technical characteristics without appreciably increasing its weight.

To this end, the cross-country ski includes a longitudinal rib on its upper part and a binding holding the front of a shoe or boot on the ski, wherein, on each side of the longitudinal rib, and at the rear of the front binding in the support zone of the shoe or boot, two longitudinally spaced elements are affixed to the ski which serve as intermediate support elements between the shoe or boot and the ski. Specifically, the invention includes a front support element positioned near the front binding, on which the front of the shoe or boot sole is attached, and a rear support element positioned in the zone where the heel of the shoe or boot rests after the foot is lowered flat on the ski.

The front and rear support elements are made of materials having characteristics of mechanical response which can be identical or different. They can both be particularly constituted by a relatively rigid material or a soft or elastic material. Alternatively, one of them can be of a relatively rigid material and the other of a relatively soft material. It is thus possible to adapt the response characteristics of the front and rear support elements to the level of the skier and particularly to the technique of skiing.

Figure 1:
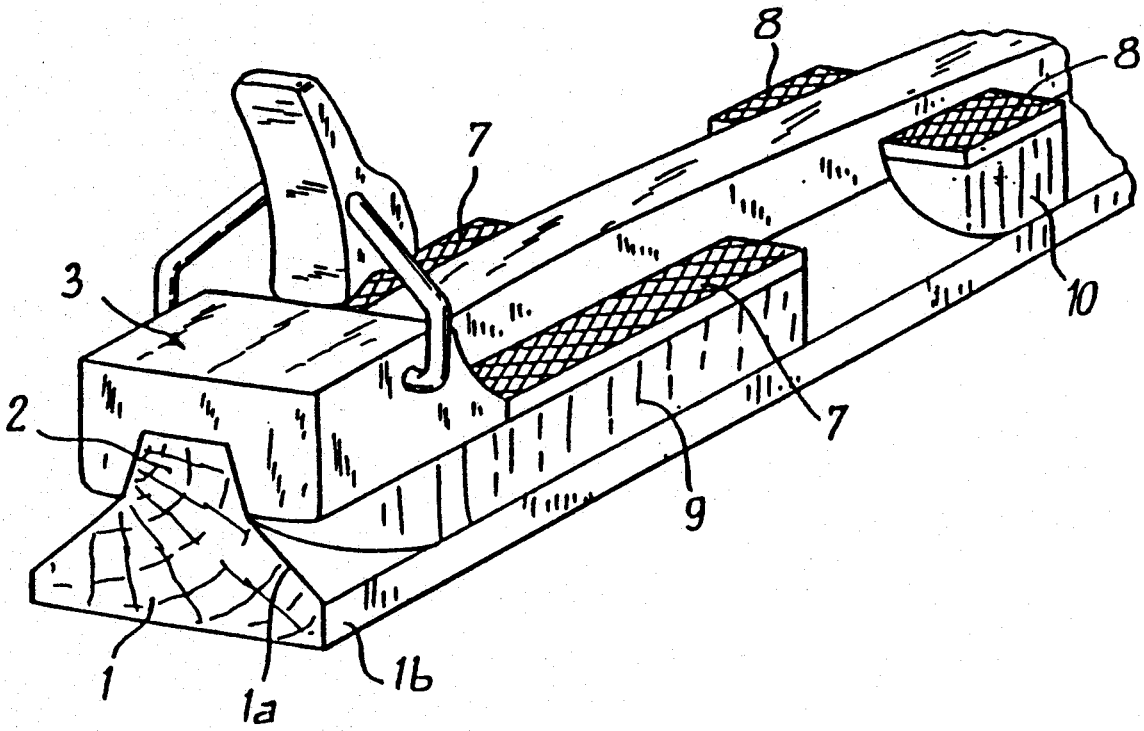
FIG. 1 is a partial perspective view of a cross-country ski according to the invention.
Figure 2:
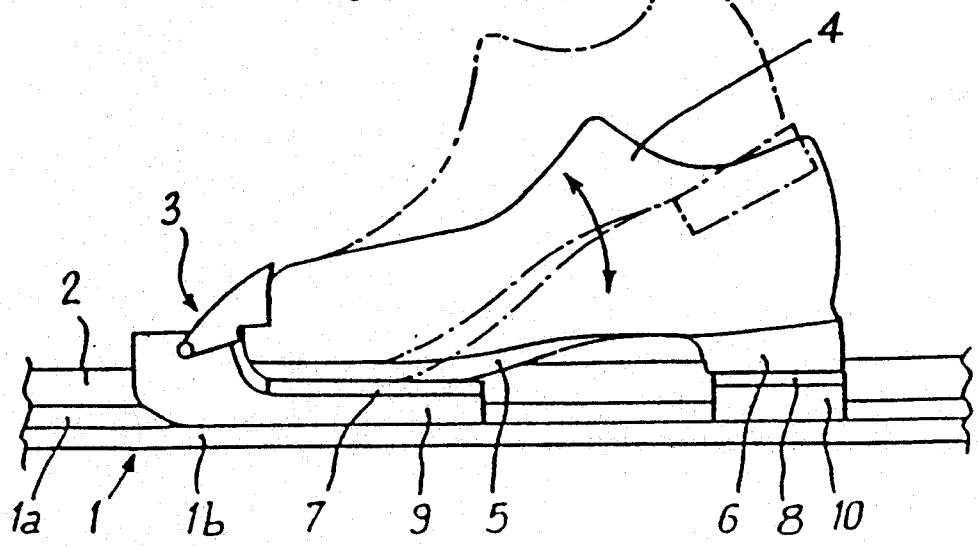
FIG. 2 is an elevation view of a cross-country ski according to the invention on which a ski shoe or boot is affixed.

In FIGS. 1 and 2 a cross-country ski is shown which has, on its upper part, a longitudinal rib 2. This rib can have a trapezoidal cross-section, as is shown in the drawing, or any other appropriate shape. A binding 3 is affixed on the rib at the appropriate location for holding the front of a shoe or boot 4. The sole 5 and the heel 6 of the shoe or boot are provided with respective longitudinal grooves covering the longitudinal rib 2 during the practice of skiing, so as to ensure the lateral guidance of the shoe or boot.

While FIG. 1 illustrates a perspective view of the ski and the shoe or boot support apparatus, FIG. 2 illustrates, in elevation, the ski and support apparatus with a shoe or boot attached to the binding 3. The shoe or boot is shown positioned flat on the ski, supported by the support apparatus further described below, in solid lines. In phantom lines, the shoe or boot is shown in a raised position as it repeatedly pivots by means of the front binding during the course of cross-country skiing, as schematically illustrated by the double-headed arrow in FIG. 2.

According to the invention, the cross-country ski is equipped, along each side of the longitudinal rib 2, with two support elements, namely, a front support element 7, near the binding 3, on which the front part of the sole 5 rests, and a rear support element 8, positioned in the zone where the heel 6 of the shoe or boot rests when it is in its lowered position. These support elements 7, 8 are affixed to the ski by any appropriate means, for example by gluing, and they can be affixed directly to the sides of the longitudinal rib 2 as well as to the edges 1*a* of the ski, which extend between the base of the upper longitudinal rib 2 and the sides 1*b* of the ski. If the edges 1*a* are inclined from top to bottom, from the rib 2 in the direction of the sides 1*b*, the support elements 7, 8 can have a transverse section having a lower surface with the same inclination, so that their upper surfaces are horizontal. In the embodiment shown in FIG. 1, the support elements 7, 8 are constituted by layers of material affixed to the upper horizontal surfaces of intermediate elements 9, 10 themselves affixed to edges 1*a* of the ski and making it possible to "correct" the slope of edges 1*a* of ski 1.

The mechanical response characteristics of the support elements 7, 8 are selected with respect to the ability level of the skier. For example, a skier with a high level of skill tends to seek maximum rebound when he makes moves towards the front by leaning on his skis. In this case, the material chosen for the front support element 7 would be of the elastic type, such as synthetic or natural rubber (latex, neoprene, e.g.). On the other hand, the skier may also require an efficient control of the heel in turns. To obtain this result, the selected material constituting the rear support element 8 should be stiff, such as polyamide. If the skier, while retaining the characteristic of elastic rebound by the front support element 7, desires a certain amount of comfort with regard to the support for the heel 6, the material selected for the rear support element 8 should be of the shock absorbing type, i.e., relatively soft, since this is the area where most of the shocks occur.

If the skier is satisfied with skiing on a posted run, without going into competition, then it is preferable, to ensure maximum comfort for the skier, that both the front and rear elements 7 and 8 are both made of a relatively soft shock absorbing material.

If the skier is adept with the skating step, the front support element 7 is preferably made of a rigid material, to ensure maximum guidance in the support zone of the metatarses, while the rear support element 8, positioned in the zone where shocks are produced, is preferably made of a soft shock absorbing material.

Although in the preceding description the invention has been described in connection with a cross-country ski having an upper longitudinal rib 2 which is integral with the rest of the ski, the invention could likewise be applied to a cross-country ski having a rectangular, or substantially rectangular, transverse vertical section and onto which a longitudinal element constituting the equivalent of the previously mentioned rib 2 is mounted.

Further, the front and rear support elements 7 and 8 can be either filled or hollow and they can have a constant or variable thickness in the longitudinal and/or transverse direction.

Although the invention has been described with reference to particular means, materials, and embodiments, it is to be understood that the invention is not limited to the particulars disclosed, but extends to all equivalents within the scope of the claims.

What is claimed is:

1. A cross-country ski having an upwardly projdcting longitudinally extending rib, said rib having an upper surface, said ski further comprising a front support element positioned on either side of said longitudinally extending rib proximate an area of said ski at which a front binding is to be located, and a rear support element positioned on either side of said longitudinally extending rib and longitudinally spaced from respective ones of said front support elements, said rear support elements being located proximate an area of said ski at which the heel of a shoe or boot is to be located during the course of skiing, while said shoe or boot is attached to said front binding, wherein each of said front support elements and said rear support elements have respective shoe or boot-engaging support surfaces positioned at a level beneath said upper surface of said rib.

2. The cross-country ski of claim 1 wherein said front support element and said rear support element are made of materials having identical, or substantially identical, mechanical response characteristics.

3. The cross-country ski of claim 1 wherein said front support element and said rear support element are made of materials having different mechanical response characteristics.

4. The cross-country ski of any of claims 1–3 wherein said front support element and said rear support element are attached to said ski with glue.

5. The cross-country ski of claim 4 wherein said longitudinally extending rib has side surfaces and wherein said ski has further side surfaces spaced from said side surfaces of said rib, wherein said front support element and said rear support element are each constituted by material layers which are affixed directly to said side surfaces of said rib and to said ski between said side surfaces of said rib and said further side surfaces of said ski.

6. The cross-country ski of claim 4 wherein said longitudinally extending rib has side surfaces and wherein said ski has further side surfaces spaced from said side surfaces of said rib, further comprising longitudinally spaced front and rear intermediate elements, wherein said front support element and said rear support element each comprise a material layer which is affixed onto respective surfaces of said front and rear intermediate elements.

7. The cross-country ski of any of claims 1-3 wherein said front support element is comprised of an elastic material.

8. The cross-country ski of claim 4 wherein said front support element is comprised of an elastic material.

9. The cross-country ski of claim 5 wherein said front support element is comprised of an elastic material.

10. The cross-country ski of claim 6 wherein said front support element is comprised of an elastic material.

11. The cross-country ski of any of claims 1-3 wherein said front support element is comprised of a rigid material.

12. The cross-country ski of claim 4 wherein said front support element is comprised of a rigid material.

13. The cross-country ski of claim 5 wherein said front support element is comprised of a rigid material.

14. The cross-country ski of claim 6 wherein said front support element is comprised of a rigid material.

15. The cross-country ski of any of claims 1-3 wherein said rear support element is comprised of a soft shock-absorbing material.

16. The cross-country ski of claim wherein said rear support element is comprised of a soft shock-absorbing material.

17. The cross-country ski of claim 5 wherein said rear support element is comprised of a soft shock-absorbing material.

18. The cross-country ski of claim 6 wherein said rear support element is comprised of a soft shock-absorbing material.

19. The cross-country ski of any of claims 1-3 wherein said rear support element is comprised of a rigid material.

20. The cross-country ski of claim 4 wherein said rear support element is comprised of a rigid material.

21. The cross-country ski of claim 5 wherein said rear support element is comprised of a rigid material.

22. The cross-country ski of claim 6 wherein said rear support element is comprised of a rigid material.

23. The cross-country ski of claim 1 wherein said ski comprises inclined edge surfaces and wherein said front support element and said rear support element are affixed to an inclined edge surface, each of said support surfaces of said front support elements and said rear support elements are generally horizontally positioned for supporting respective portions of said shoe or boot.

24. A support apparatus for a cross-country ski having a longitudinally extending rib in which said rib has an upper surface, said support apparatus comprising:

(a) means for engagingly supporting a front portion of a shoe or boot on either side of said longitudinally extending rib below said upper surface of said rib during cross-country skiing; and (b) means for engagingly supporting a rear portion of said shoe or boot on either side of said longitudinally extending rib below said upper surface of said rib during cross-country skiing, which is to be distinct from and longitudinally spaced rearwardly from said means for supporting a front portion of said shoe or boot.

25. The support apparatus of claim 24 wherein said means for supporting a front portion of said shoe or boot and said means for supporting a rear portion of said shoe or boot are made of materials having identical, or substantially identical, mechanical response characteristics.

26. The support apparatus of claim 24 wherein said means for supporting a front portion of said shoe or boot and said means for supporting a rear portion of said shoe or boot are made of materials having different mechanical response characteristics.

27. The support apparatus of any of claims 24-26 wherein said means for supporting a front portion of said shoe or boot and said means for supporting a rear portion of said shoe or boot are attached to said ski with glue.

28. The support apparatus of claim 27 wherein said longitudinally extending rib has side surfaces and wherein said ski has further side surfaces spaced from said side surfaces of, said rib, wherein said means for supporting a front portion of said shoe or boot and said means for supporting a rear portion of said shoe or boot are each constituted by material layers which are affixed directly to said side surfaces of said rib and to said ski between said side surfaces of said rib and said further side surfaces of said ski.

29. The support apparatus of claim 27 wherein said longitudinally extending rib has side surfaces and wherein said ski has further side surfaces spaced from said side surfaces of said rib, further comprising longitudinally spaced front and rear intermediate elements, wherein said means for supporting a front portion of said shoe or boot and said means for supporting a rear portion of said shoe or boot each comprise a material layer which is affixed onto respective surfaces of said front and rear intermediate elements.

30. The support apparatus of claim 24 wherein said ski comprises inclined edge surfaces and wherein said means for supporting a front portion of said shoe or boot and said means for supporting a rear portion of said shoe or boot are affixed to an inclined edge surface, each of said means for supporting a front portion of said shoe or boot and said means for supporting a rear portion of said shoe or boot have relatively horizontal support surfaces for supporting respective portions of said shoe or boot.

31. The support apparatus of claim 26 wherein said means for supporting a front portion of said shoe or boot is comprised of a relatively rigid material and wherein said means for supporting a rear portion of said shoe or boot is comprised of a soft, shock-absorbing material.

32. The support apparatus of claim 24 wherein said means for supporting a front portion of a shoe or boot comprise a pair of separate and independent support elements laterally separated by at least a portion of the rib when positioned on the ski.

33. A cross-country ski having an upwardly projecting longitudinally extending rib, said ski further comprising a front support element positioned on either side of said longitudinally extending rib proximate an area of said ski at which a front binding is to be located, and a rear support element positioned on either side of said longitudinally extending rib and longitudinally spaced from respective ones of said front support elements, said rear support elements being located proximate an area of said ski at which the heel of a shoe or boot is to be located during the course of skiing, while said shoe or boot is attached to said front binding, wherein said longitudinally extending rib has side surfaces and an upper surface, wherein said ski has further side surfaces spaced from said side surfaces of said rib, said ski further comprising longitudinally spaced front and rear intermediate elements, wherein said front support element and said rear support element each comprises a material layer which is affixed onto respective surfaces of said front and rear intermediate elements for engaging said shoe or boot at a location below said upper surface of said rib.

34. A support apparatus for a cross-country ski having a longitudinally extending rib, said rib having side surfaces and an upper surface, and said ski having further side surfaces spaced from said side surfaces of said rib, said support apparatus comprising:

(a) means for supporting a front portion of a shoe or boot on either side of said longitudinally extending rib during cross-country skiing;

(b) means for supporting a rear portion of said shoe or boot on either side of said longitudinally extending rib during cross-country skiing, which is to be distinct from and longitudinally spaced rearwardly from said means for supporting a front portion of said shoe or boot; and (c) longitudinally spaced front and rear intermediate elements, wherein each of said means for supporting a front portion of said shoe or boot and said means for supporting a rear portion of said shoe or boot comprises a material layer which is affixed onto respective surfaces of said front and rear intermediate elements for engaging said shoe or boot at a location below said upper surface of said rib.

* * * * *

UNITED STATES PATENT AND TRADEMARK OFFICE

CERTIFICATE OF CORRECTION

PATENT NO. : 5,029,889

DATED : July 9, 1991

INVENTOR(S) : Alain Bejean, et al.

It is certified that error appears in the above-identified patent and that said Letters Patent is hereby corrected as shown below:

At column 1, line 7, of the printed patent, insert ---which--- before "includes".

At column 4, line 26, (claim 1, line 1) of the printed patent, change "projdcting" to ---projecting---.

At column 6, line 16 of the printed patent, delete "," after "of".

Signed and Sealed this

Second Day of March, 1993

*Attest:*

STEPHEN G. KUNIN

*Attesting Officer*

*Acting Commissioner of Patents and Trademarks*